US005538799A

United States Patent [19]

Nanya et al.

[11] Patent Number: 5,538,799

[45] Date of Patent: Jul. 23, 1996

[54] KNITTING PARTS OF KNITTING MACHINE

[75] Inventors: Takanori Nanya, Sayama; Mitugu Enomoto, Higashikurume, both of Japan

[73] Assignees: Citizen Watch Co., Ltd., Tokyo; Nippon Mayer Ltd., Fukui, both of Japan

[21] Appl. No.: 325,269

[22] PCT Filed: Feb. 25, 1994

[86] PCT No.: PCT/JP94/00310

§ 371 Date: Oct. 26, 1994

§ 102(e) Date: Oct. 26, 1994

[87] PCT Pub. No.: WO94/20660

PCT Pub. Date: Sep. 15, 1994

[30] Foreign Application Priority Data

Mar. 2, 1993 [JP] Japan ..... 5-13660 U

[51] Int. Cl.[6] ..... B32B 15/08

[52] U.S. Cl. ..... 428/626; 428/627; 428/638; 428/641; 428/660; 428/450; 428/457; 66/123

[58] Field of Search ..... 428/626, 627, 428/638, 641, 660, 450, 457; 66/123

[56] References Cited

U.S. PATENT DOCUMENTS

| | | | |
|---|---|---|---|
| 3,882,695 | 5/1975 | Flicken | 66/114 |
| 4,822,662 | 4/1989 | Ishing et al. | 428/131 |
| 5,077,990 | 1/1992 | Plath | 66/123 |

FOREIGN PATENT DOCUMENTS

| | | |
|---|---|---|
| 58-31141 | 2/1983 | Japan . |
| 61-186558 | 8/1986 | Japan . |
| 62-28452 | 2/1987 | Japan . |
| 4-41755 | 2/1992 | Japan . |

*Primary Examiner*—Mark D. Sweet

*Attorney, Agent, or Firm*—Armstrong, Westerman, Hattori, McLeland & Naughton

[57] ABSTRACT

In knitting parts of a knitting machine(a guide, needle tongue and the like of a warp knitting machine), an anti-corrosion layer 12 formed by wet plating, an intermediate layer 14 formed by dry plating and a hard carbon film 16 formed by dry plating are successively laminated on and applied to, at least, a surface of that portion of a carbon steel base material 10 shaped to profile the knitting parts, which portion contacts with knitting yarn, and the anti-corrosion layer 12 formed by wet plating is applied to a surface other than the portion. So, the anti-corrosion layer prevents rust and corrosion which would otherwise be developed on a surface of the carbon steel base material 10, and the hard carbon film is firmly and adhesively applied, at least, to the surface of the portion contacting with the knitting yarn with the intermediate layer therebetwen, so that the thickness of the entire film is made small to provide an adequate wear resistance without impairing toughness of the base material, thereby markedly improving the durability.

6 Claims, 2 Drawing Sheets

KNITTING PARTS OF KNITTING MACHINE

TECHNICAL FIELD

This invention relates to knitting parts such as a guide, needle, tongue, sinker, separator, jacquard guide needle and the like which have a portion contacting with knitting yarn when they are fitted to a knitting machine to perform knitting, and particularly to surface coating technology to improve durability of such parts.

BACKGROUND OF TECHNOLOGY

This invention will be described using a warp knitting machine as an example, though knitting machines include a warp-, flat- and circular knitting machine and the like, and similarly it can be applied to such a weft or circular machine.

The warp knitting machine is roughly classified into tricot and raschel machines, on which a sectional beam wound with knitting yarn or warp end is usually mounted, the warp end being supplied therefrom to a knitting needle line to perform knitting.

The knitting parts (tool) consisting of a knitting section of a warp knitting machine comprises a thin sheet formed "guide" of about 200 μm thick which is located between a sectional beam and a knitting needle line and has a hole to guide knitting yarn or warp end, a thin sheet-formed "needle" with a hook on a head end for knitted stitch formation, and a thin sheet-formed "tongue", which cooperatively participates in the knitted stitch formation together with the needle, and "sinker", as well as "separator", "jacquard guide needle", etc., in general, a number of such parts being arranged parallel at very close spaces to form a block.

Generally, from viewpoints of easy processing and wear resistance, a carbon steel base material shaped to profile each of these parts is coated by means of wet chromium plating and used as various knitting parts described above.

The durability of such knitting parts, however, has been in serious question due to speeding up of knitting machines, diversification of materials for knitting yarn such as high strength fibers or modified fibers and employment of various kinds of sizes.

Namely, the knitting parts such as guide, needle, tongue, sinker, separator, jacquard guide needle, etc. tend to be worn out at a portion contacting with knitting yarn, which would cause hairiness or end breakage of the yarn, and thus the durability of such parts is an important factor to decide the operational effectiveness of machines and the cost of products because it requires a great deal of expense, effort and time to replace a great number of these parts used in a machine so as to prevent such a trouble of the yarn described above.

Then, it has been proposed to coat the surface of knitting parts (tool) for warp knitting machines with high hardness coating of metals such as tantalum (Ta), tungsten (W), titanium nitride (TiN), titanium-tungsten alloy (TiW), etc. (see Japanese Patent Laid-Open Publication No. 4-41,755).

It has also been known, however, that wearing of knitting parts typically represented by the guide is a phenomenon difficulty caused by kinds of fibers, impact pressure, vibration characteristics, etc., and that satisfied results are not necessarily obtained by a coating of high surface hardness.

In fact, in the case of a guide coated with titanium nitride which is known as a coating of a high hardness compound, no increase in durability was observed, compared with conventional one coated by means of chromium plating, and aroused a problem that the substrate was softened due to a higher treating temperature.

Further, it is also reported that the toughness of a base material itself is lost and, as a result, the durability is decreased on the contrary when a coating of high hardness is thickly formed on the base material. From this point of view, it is necessary to improve the durability without spoiling inherent properties of the substrate.

Accordingly, this invention has been accomplished in consideration of such a technical background described above, and it is an object of this invention to greatly improve the durability of knitting parts so as to be widely suited to various yarn made of a variety of materials including from natural fibers to high strength synthetic fibers, thereby the operational effectiveness of knitting machines and the cost of products being increased and decreased, respectively.

DISCLOSURE OF THE INVENTION

As is described above, this invention provides knitting parts which have a portion contacting with knitting yarn when the parts are fitted to a knitting machine to perform knitting, characterized in that an anti-corrosion layer formed by wet plating, an intermediate layer formed by dry plating and a hard carbon coating formed by dry plating are successively laminated to and applied to, at least, a surface of that portion of a carbon steel base material shaped to profile the knitting parts, which portion contacts with knitting yarn and only the anti-corrosion layer formed by said wet plating is applied to a surface other than the portion.

In this manner, any rust or corrosion on the surface of the carbon steel base material is prevented by the anti-corrosion layer, while an entire film thickness can be decreased to yield sufficient durability without losing the toughness of the base material because the hard carbon layer is coated firmly and adhesively at least on the surface of the portion contacting with the knitting yarn through the intermediate layer, and furthermore, the base material can never be softened nor deformed due to a lower treating temperature, which allows the durability of knitting parts to improve greatly.

It is desirable that such a film formation should be done after at least the surface of said portion contacting with the knitting yarn of the carbon steel base material shaped to profile the knitting parts to condition the surface roughness of 0.2 μm or less.

It is also preferable to form a film of laminated structure comprising a lower layer of chromium or titanium and an upper layer of silicon or germanium.

Moreover, said anti-corrosion layer is preferably a wet plating layer of chromium or nickel.

This invention will further be described concretely in the following. Since the carbon steel base material used as a substrate of knitting parts for knitting machines tends to rust easily and, on the other hand, the hard carbon film is difficult to be adhered firmly and directly on a metal surface, the anti-corrosion layer is formed to prevent rusting or corrosion of the carbon steel base material as well as the intermediate layer is formed to be firmly applied to, at least, the portion contacting with the knitting yarn.

As the anti-corrosion layer for rust prevention in the process, a wet plating layer of chromium (Cr), nickel (Ni), etc. is formed. While as the intermediate layer, a coating of laminated structure comprising a lower layer of chromium (Cr) or titanium (Ti) and a upper layer of silicon (Si) or germanium (Ge), a carburized layer which includes a carbide on the substrate surface by means of a carburizing treatment, and a carbide layer of IVa or Va group metals, etc. are formed.

The hard carbon film used in this invention means an amorphous carbon film including hydrogen formed by, for example, a plasma CVD (Chemical Vapor Deposition) treatment under a gaseous atmosphere of hydrocarbon (methane), and is known that it has higher hardness, higher thermal conductivity and lower rate of wear. It is also known that characteristically higher tensile strength and lower internal friction thereof can result in prominent vibration properties in a high frequency zone.

Although it has not fully been known yet about behavior of the hard carbon film when the knitting parts are worn away by the knitting yarn at high speed, not only higher surface hardness and lower friction coefficient of the film but prominent thermal conductivity and vibration properties thereof seem to significantly contribute to improve the durability. Further, since such a friction phenomenon is occurred by the knitting yarn of several tens μmϕ size and accordingly it is considered that the surface roughness of carbon steel base material to form the knitting parts should be an important factor of wearing, a substantial increase in the wear resistance is actually obtained in the case of the knitting parts such as "guide" by improving at least the surface roughness of the contact surface with the knitting yarn.

BEST MODE FOR CARRYING OUT THE INVENTION

Referring now to the attached drawings, this invention will be further described in detail.

At first, referring to FIGS. 1 and 2, the first example of this invention will be described. In the example, this invention is applied to a guide, i.e., one of the knitting part for a warp knitting machine.

Figure 2:
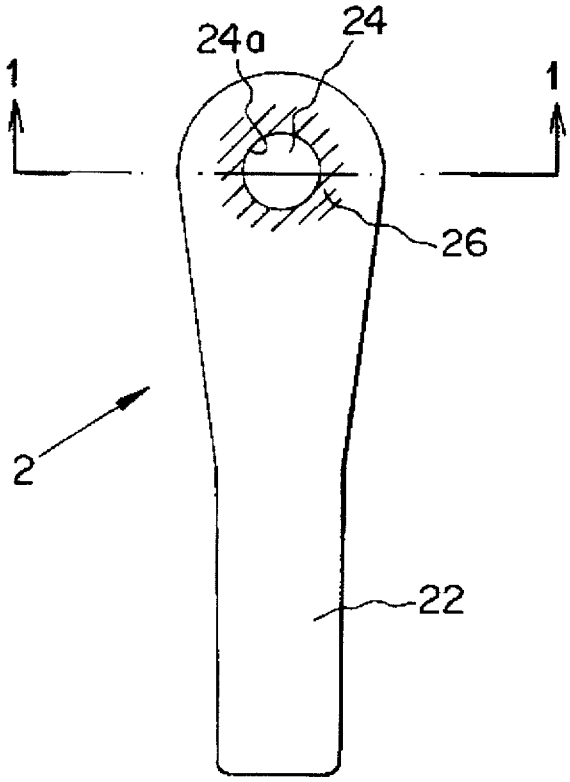
FIG. 2 is a plan view of a guide, a knitting part for a warp knitting machine shown in the first example of this invention.

As shown in FIG. 2, the guide 2 has a guide hole 24 which allows the warp end or knitting yarn to pass therethrough and guide to a needle and a fixing end 22 to attach to a holding fixture. In general, a number of guides 2 are arranged parallel each other and vertically to the plan of the paper at very close spaces to form a block so as to be fitted to the warp knitting machine.

Figure 1:
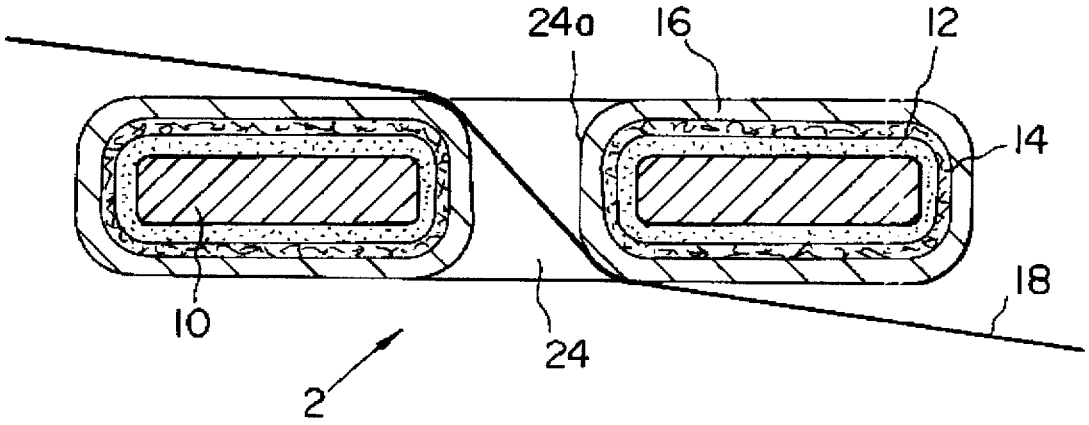
FIG. 1 is a typical enlarged sectional view of a guide taken on line A–A' of FIG. 2.

Further, as is seen from FIG. 1 typically showing an enlarged sectional view of the guide taken on line A-A' of FIG. 2, the warp end 18 is introduced from one side surface into the guide hole 24 at an angle and passed through the other side surface.

A shaded part 26 in FIG. 2 is an area where the warp end 18 contacts therewith, and especially an inner peripheral edge 24*a* of the guide hole 24 and a surface area neighboring therewith should be subjected to the severest friction.

Thus, in this example, an anti-corrosion layer 12 formed by wet plating, an intermediate layer 14 formed by dry plating and a hard carbon formed 16 formed by dry plating are successively applied, as shown in FIG. 1, to a surface including at least the portion 26 where the warp end 18 (FIG. 1) of a carbon steel base material 10 (FIG. 1) shaped to profile the guide shown in FIG. 2, and only the anti-corrosion layer 12 formed by wet plating is applied to a surface of other area.

Figure 3:
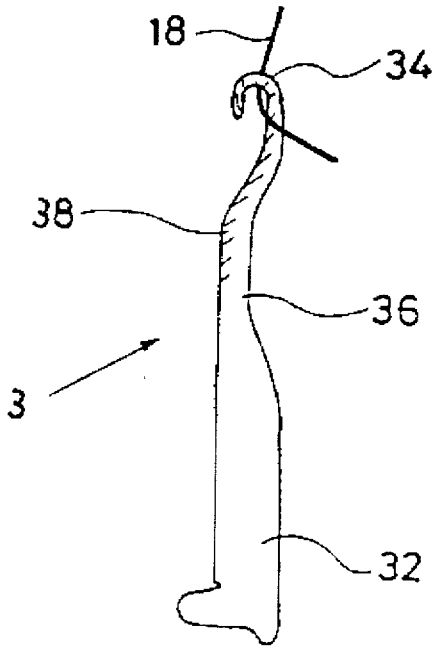
FIG. 3 is a plan view of a needle, an another knitting part for a warp knitting machine shown in the second example of this invention.

FIG. 3 is a plan view of a needle, another knitting part for a warp knitting machine shown in the second example of this invention. The needle 3 consists of a hook 34 to hook thereto the knitting yarn or warp end 18, a stem 36 and a fixing end 32 to attach to a holding fixture.

Since knitted stitches are formed while the warp end 18 moves from the stem 36 to an inner periphery of the hook 34, a shaded part 38 in FIG. 3 is an area where the warp end 18 contacts therewith and a peripheral edge and a surface area neighboring therewith should be subjected to the severest friction.

Thus, an anti-corrosion layer formed by wet plating, an intermediate layer formed by dry plating and a hard carbon film formed by dry plating are successively applied in a similar manner as above described example (see FIG. 1) to a surface including at least the portion 38 of a carbon steel base material shaped to profile the needle 3, and only the anti-corrosion layer formed by wet plating is successively applied to a surface other than the portion.

Figure 4:
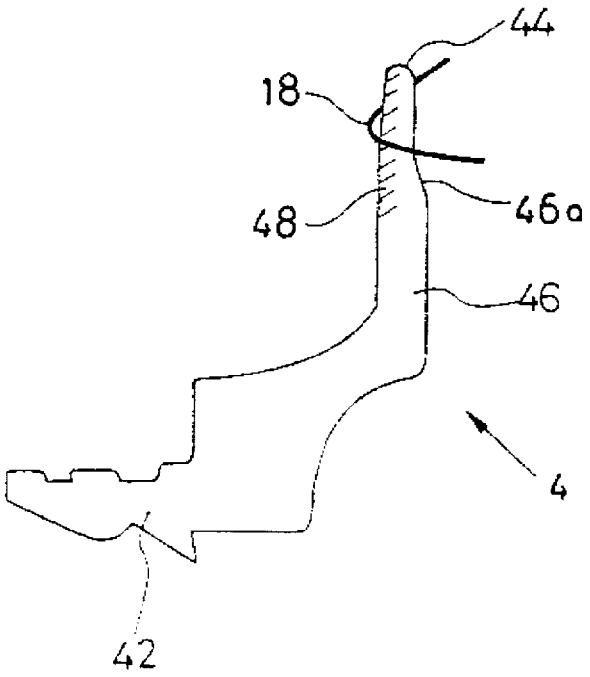
FIG. 4 is a plan view of a tongue, a still another knitting part for a warp knitting machine shown in the third example of this invention.

FIG. 4 is a plan view of a tongue, still another knitting part for a warp knitting machine shown in the third example of this invention. The tongue 4, which is usually incorporated with the needle for a cooperative operation, consists of a head end 44 worn due to a contact with the warp end 18, a stem 46 and a fixing end 42 to attach to a holding fixture.

Since knitted stitches are formed while the warp end 18 moves from the head end 44 to a side where a level difference 46*a* on the stem 46, a shaded part 48 in FIG. 4 is an area where the warp end 18 contacts therewith and a peripheral edge and a surface area neighboring therewith should be subjected to the severest friction.

Thus, an anti-corrosion layer formed by wet plating, an intermediate layer formed by dry plating and a hard carbon film formed by dry plating are applied successively in a similar manner as above described example (see FIG. 1) to a surface including at least the portion 48 of a carbon steel base material shaped to profile the needle 3, and only the anti-corrosion layer formed by wet plating is applied to a surface other than the portion.

As a base material of knitting parts for warp knitting machine such as guide 2, needle 3 and tongue 4 shown in these examples, carbon steel is employed from a stand point of easy processing, hardness, toughness, etc. thereof.

Referring to FIG. 1, an example of film forming process will be detailed in the following with regard to guide 2. Needle 3 and tongue 4 are similarly processed.

Since it seems that the surface roughness of an area where the guide 2 is subjected to friction of the warp end 18, i.e., an inner peripheral edge 24*a* of the guide hole 24 and the surface part neighboring therewith should affect considerably to the durability, the surface including at least such a portion (the portion 26 shown in FIG. 2) of the carbon steel base material was polished by a barrel treatment.

Simultaneous polishing of the surface of the carbon steel base material 10 as well as the inner periphery of the guide hole 24 was conducted conveniently by, for example, using a centrifugal barrel containing copper balls, a compound and water together with the carbon steel substrate 10 and optimizing particle diameter of the copper balls and number of revolutions of the barrel.

The substrate surface roughness Ra (mean) of a contact area with the knitting yarn was determined and the result was Ra≈0.1 μm.

A chromium coating of 2 μm thick as the anti-corrosion layer 12 was then formed by a wet plating method under a condition below.

| (l: liter; A: ampere) << chromium plating >> | |
|---|---|
| < composition of plating solution > | |
| chromic anhydride | 200~300 g/l |
| sulfuric acid | 2~3 g/l |
| trivalent chromium | 1~5 g/l |
| < plating condition > | |
| bath temperature | 40~55° C. |
| current density | 10~60 A/dm$^2$ |

In this manner a coating of laminated structure was obtained by forming the anti-corrosion layer 12 of chromium film over the whole surface of the carbon steel base material 10 followed by successive formation of a titanium film of 0.1 μm thick and a silicon film of 0.3 μm thick as the intermediate layer 14 by means of a dry plating method such as sputtering.

In this case, the titanium film is required to be allocated at a side in contact with the chromium film of the lower anti-corrosion layer 12 and the silicon film is required to be allocated at a side in contact with the upper hard carbon film. However, an inside of the film of the intermediate layer is not necessarily a laminated structure but a so called inclined one.

Finally the hard carbon film 16 was applied by a dry plating method such as radio frequency plasma CVD (RF-P-CVD) method under the following condition.

| << hard carbon film >> | |
|---|---|
| < formation condition > | |
| kind of gas | methane ($CH_4$) gas |
| film forming pressure | 0.1 Torr |
| input power | 300 watt |
| thickness of film | 1 μm |

A required number of guides 2 thus film-formed thereon was blocked to fit to the warp knitting machine, tested the durability under a test condition below and compared with conventional ones. As a result, when conventional guides which were formed of carbon steel base material and applied only by chromium plating film (20 μm) were used, worn scars were observed and hairiness and end breakage were resulted in after a month or so, while in the case of present guides used in the example, no worn scar was found even after a month and an extraordinary improvement on durability (10 to 30 times) compared with conventional guides was ascertained.

| < test condition > | |
|---|---|
| machine used | tricot machine |
| knitting yarn used | high-tenacity polyester yarn 50d 48f semidull (mixed with $TiO_2$) |
| rotation speed (knitting speed) | 1000 rpm |

Such a marked effect was also confirmed when knitting yarn made up of materials including not only natural fibers but carbon fibers, aramide fibers, reinforced plastic fibers, glass fibers, high-tenacity vinylon fibers, etc. Further, when a similar film was formed on needles and tongues, the same effect was recognized and a substantial effectiveness of this invention to friction caused by knitting yarn was demonstrated.

When the hard carbon film was formed directly on the carbon steel base material without forming the wet plating layer as an anti-corrosion layer, corrosion developed after a pre-washing process, and a slight peel was found by a metallurgical microscopic observation, etc. after the hard carbon film was formed. A progress of wear from a peeling point was observed after a durability test of this film, which suggested that such a structure was not suitable to improve the durability.

Further, when the hard carbon film was formed on the anti-corrosion layer without forming the intermediate layer by dry plating, a firm adhesion thereof was not obtained.

Although a centrifugal barrel was employed as an example of polishing method in the above example, how to polish is not limited by this method. However, it should be necessary that any warpage or deformation of the base material is not resulted in, and that a portion to be subjected to friction by knitting yarn, such as inner periphery of guide hole in case of the guide and inner periphery of hook in case of the needle can be polished.

A relationship between the surface roughness of base materials obtained under various conditions of barrel treatment and the wear resistance of base materials during friction by knitting yarn was investigated. As a result, it was found that the wear resistance increases as the surface roughness Ra decreases and a considerable improvement is obtained at a point of Ra≦0.2 μm.

While the hard carbon film may be formed over a whole surface of the knitting parts, an area to be contacted with knitting yarn is limited to each edge and a surface neighboring therewith and accordingly it is sufficient that only such areas are covered by the hard carbon film.

In this case, an area where the hard carbon film is not applied except the head end to fix to the holding fixture should be covered by the anti-corrosion layer formed by wet plating from a standpoint of corrosion protection, usually thickness thereof being in the range of 1 to 10 μm. Even if any defects existed with respect to the hard carbon film, the carbon steel base material could be easily protected from wearing when the anti-corrosion layer under the hard carbon film is applied thickly.

A chromium film was employed as an example of the anti-corrosion layer, i.e., a wet plating layer, but such a layer is not limited to this example and a nickel alloy film or a composite plating film with other materials can be used satisfactorily.

On the other hand, a film of laminated structure comprising titanium and silicon was employed as an example of the intermediate layer, but here again such layer is not limited to this example and other film of laminated structure comprising chromium, for example, instead of titanium, carburized layer, carbide layer of metals belonging to IVa and Va groups and the like may be used. When the chromium film is used as a wet plating layer, the lower layer of the intermediate (a layer of titanium, chromium, etc.) can be omitted.

RF-P-CVD method was employed as an example how to form the hard carbon film, but such a method is not limited to this example and other forming method such as a direct current plasma CVD method (DC-P-CVD method) may be used.

Furthermore, a film in which hydrogen contained in the hard carbon film is partially substituted by fluorine, a composite film with other materials and the like are applicable. Because of higher film stress of the hard carbon film, a preferable result is not necessarily obtained by a thicker film, usually the thickness being limited to less than 10 μm. Taking into consideration of a covering effect and economical efficiency, a thickness less than 3 μm is preferable.

While this invention has been described in the example above with regard to the guide, needle and tongue as the knitting parts of warp knitting machine, a similar effect can also be expected when this invention is practiced regarding other knitting parts such as sinker, separator, jacquard guide needle and the like.

It has been further recognized that this invention is similarly effective to those parts of flat- and circular knitting machines other than the warp knitting machine.

While the chromium plating film applied to the surface of the carbon steel base material in conventional knitting parts is required to have a film thickness of about 20 μm, a total film thickness of these knitting parts according to this invention shows sufficient durability even at a thickness of 4 μm or so and additionally, any dimensional distortion caused by softening and deformation of the base material does not occurred because of lower treating temperature of the film around 200° C., thereby the present parts being capable to have the same dimensional design as conventional one. In addition, it is an especially great effect to the durability improvement of the knitting parts that a superior wear resistance can be given without losing toughness of the carbon steel metal due to decreased thickness of the film.

INDUSTRIAL UTILIZATION

According to this invention, as has been described above, the durability of knitting parts of knitting machine such as guide, needle, tongue, separator, jacquard guide needle and the like is markedly improved and, at the same time, these parts can be applied to knitting yarn made up of wider kinds of materials including from natural fibers to synthetic ones, thereby an operational effectiveness of knitting machines being considerably improved and the cost of products being decreased.

This invention can be used to improve the durability of all knitting parts which have a contact area with knitting yarn when they are fitted to various kinds of knitting machines such as warp-, flat- and circular machines, etc. to perform knitting.

We claim:

1. Knitting parts which have a portion contacting with knitting yarn when the knitting parts are fitted to a knitting machine to perform knitting, characterized in that an anti-corrosion layer formed by wet plating, an intermediate layer formed by dry plating and a hard carbon film formed by dry plating are successively laminated on and applied to, at least, a surface of that portion of a carbon steel base material shaped to profile the knitting parts, which portion contacts with knitting yarn, said anti-corrosion layer formed by wet plating being concurrently applied to other surfaces of said carbon steel base material.

2. Knitting parts of knitting machine claimed in claim 1, in which surface roughness Ra of at least said portion, contacting with the knitting yarn, of said carbon steel base material is controlled to $Ra \leqq 0.2$ μm.

3. Knitting parts of knitting machine claimed in claim 1, in which said intermediate layer is composed of a film of laminated structure comprising chromium or titanium as a lower layer and silicon or germanium as an upper layer.

4. Knitting parts of knitting machine claimed in claim 1, in which said anti-corrosion layer is a chromium or nickel wet plating layer.

5. Knitting parts of knitting machine claimed in claim 1, in which surface roughness Ra of said portion, contacting with the knitting yarn, is controlled to $Ra \leqq 0.2$ μm and said inter mediate layer is composed of a film of laminated structure comprising chromium or titanium as a lower layer and silicon or germanium as an upper layer.

6. Knitting parts of knitting machine claimed in claim 1, in which surface roughness Ra of said portion, contacting with the knitting yarn, is controlled to $Ra \leqq 0.2$ μm, said anti-corrosion layer is a chromium or nickel wet plating layer and said intermediate layer is composed of a film of laminated structure comprising chromium or titanium as a lower layer and silicon or germanium as an upper layer.

* * * * *